US006669443B2

(12) United States Patent
Burnett et al.

(10) Patent No.: US 6,669,443 B2
(45) **Date of Patent: *Dec. 30, 2003**

(54) ROTOR PLATFORM MODIFICATION AND METHODS USING BRUSH SEALS IN DIAPHRAGM PACKING AREA OF STEAM TURBINES TO ELIMINATE ROTOR BOWING

(75) Inventors: Mark Edward Burnett, Buskirk, NY (US); Christopher Edward Wolfe, Schenectady, NY (US); Frederick George Baily, Ballston Spa, NY (US); Norman Arnold Turnquist, Sloansville, NY (US); Bruce William Brisson, Galway, NY (US); David Alan Caruso, Ballston Lake, NY (US)

(73) Assignee: General Electric Company, Schenectady, NY (US)

( * ) Notice: Subject to any disclaimer, the term of this patent is extended or adjusted under 35 U.S.C. 154(b) by 83 days.

This patent is subject to a terminal disclaimer.

(21) Appl. No.: 09/988,022

(22) Filed: Nov. 16, 2001

(65) Prior Publication Data

US 2003/0095865 A1 May 22, 2003

(51) Int. Cl.[7] ..... F01D 11/02

(52) U.S. Cl. ..... 415/173.7; 415/174.2; 415/174.5; 415/231

(58) Field of Search ..... 415/1, 173.3, 173.5, 415/173.7, 174.2, 174.4, 174.5, 177, 230, 231

(56) References Cited

U.S. PATENT DOCUMENTS

| | | | | |
|---|---|---|---|---|
| 6,168,377 | B1 | 1/2001 | Wolfe et al. | |
| 6,290,232 | B1 * | 9/2001 | Reluzco et al. | 277/355 |
| 6,517,314 | B1 * | 2/2003 | Burnett et al. | 415/173.7 |
| 2003/0059298 | A1 * | 3/2003 | Burnett et al. | 415/174.2 |

* cited by examiner

*Primary Examiner*—Edward K. Look
*Assistant Examiner*—Richard A. Edgar
(74) *Attorney, Agent, or Firm*—Nixon & Vanderhye

(57) ABSTRACT

In a steam turbine, a combined brush and labyrinth seal is provided between a diaphragm web and a radially outwardly projecting platform between axially adjacent wheels on the rotor. The brush seal is located upstream of the labyrinth seal teeth. The platform has at least one and preferably a pair of flanges or fins projecting in opposite axial directions adjacent radial outer ends of the platform. Non-uniform heat distribution resulting from the frictional contact between the bristles of the brush seal and a sealing surface on the platform along the rotor surface affecting rotor dynamics is thereby eliminated or minimized.

11 Claims, 2 Drawing Sheets

ROTOR PLATFORM MODIFICATION AND METHODS USING BRUSH SEALS IN DIAPHRAGM PACKING AREA OF STEAM TURBINES TO ELIMINATE ROTOR BOWING

BACKGROUND OF THE INVENTION

The present invention relates to a steam turbine having brush seals between non-rotatable and rotatable components arranged and located to eliminate thermal bowing resulting from non-uniform distribution of heat about the rotatable component due to heat generated by frictional contact between the brush seal and the rotatable component and particularly relates to apparatus and methods for eliminating thermal bowing as well as axial thrust loads in the event of failure of the brush seal in such turbine.

In U.S. Pat. No. 6,168,377, of common assignee herewith, there is disclosed a steam turbine having a brush seal located between a non-rotatable component and a rotatable component of the rotor shaft. Particularly, axial flanges are provided on the dovetails of the buckets, the bucket dovetails being secured in complementary fashion to the dovetail of a rotor wheel. A brush seal comprised of an arcuate array of metal bristles projecting from the non-rotatable component toward the rotatable component, i.e., the flanges on the bucket dovetails, has bristle tips engaging with and bearing against the flange surfaces. As will be appreciated from a review of that patent, the contact between the bristles of the brush seal and the opposing sealing surface, i.e., the flanges, generates heat.

As disclosed in that patent, it is recognized that the contact between the brush seal and the sealing surface should be located radially outwardly of the rotor shaft in order to isolate the generated heat from the outer diameter of the rotor. Otherwise, the friction-generated heat may cause a non-uniform temperature distribution about the circumference of the shaft, resulting in non-uniform axial expansion of the rotor and, hence, a bow in the rotor. While various methods and apparatus are disclosed in that patent for eliminating that problem, one such solution locates the friction-generating surface on the bucket dovetail flanges radially outboard of the outer shaft diameter. In that manner, the generated heat is isolated from the rotor, eliminating any tendency of the rotor to bow.

That patented design and other designs utilize conventional labyrinth-type packing seals on the inside of the diaphragm web as a backup to the brush seal. These labyrinth seals are located directly adjacent the outer diameter of the shaft. Brush seals are, however, susceptible to wear and failure. Should a brush seal spaced outwardly from the shaft fail, e.g., the brush seal of that patented design, the sealing diameter changes from the bucket dovetail platform to the rotor shaft. This, in turn, adversely changes the pressure distribution on the shaft and the thrust on the rotor in an axial direction. Thus, rotor dynamic constraints limit the number of stages in which brush seals may be used and where labyrinth-type sealing teeth are used in lieu of such seals, there is a decrease in section efficiency due to increased secondary losses. Accordingly, there is a need to provide a sealing system for a steam turbine in which not only is the problem of thermal bowing of the steam turbine rotor due to non-uniform heat distribution resulting from contact between brush seals and complementary sealing surfaces eliminated, but also the axial thrust loads on the rotor bearings are eliminated or minimized in the event of brush seal failure.

BRIEF SUMMARY OF THE INVENTION

In accordance with a preferred embodiment of the present invention, there is provided a brush seal located radially outwardly of the outer diameter or surface of the shaft of the rotatable component to eliminate thermal bowing of the rotor due to non-uniform heat distribution. The brush seal may be applied in combination with a labyrinth seal at substantially the same radial location to eliminate thrust loads in the event of failure of the brush seal. Particularly, a platform is formed about the rotor between adjacent axially spaced wheels carrying the turbine buckets and which platform projects radially outwardly from the surface of the rotor. The platform, in a preferred embodiment, is in the form of an annular pedestal having an axially reduced neck and at least one and preferably a pair of axially extending flanges at the radial outer extremes of the platform. The one or more flanges are in effect cantilevered in an axial direction from the neck of the pedestal and serve as one or more fins enabling heat generated by frictional contact of the brush seal on the platform surface to be dissipated before affecting rotor dynamics. Thus, the platform configuration enables a sufficient area and provide flanges or fins to dissipate the heat locally, mitigating the effect on rotor vibration, thus allowing similar brush seal application to all steam turbine section stages. It will be appreciated that the cantilevered flange or fin provides a void radially between the flange or fin and the rotor surface, i.e., in the wheelspace, whereby the frictional heat generated by brush seal contact with the sealing surface of the platform is dissipated first in an axial direction and then in a radial direction before having any effect on the thermal dynamics of the rotor. The heat dissipation is sufficient to minimize or eliminate a thermal response of the rotor to the frictionally generated heat.

The diaphragm between the adjacent wheels has a web extending radially inwardly into the wheel space and, not only carries the brush seal, but also one and preferably a plurality of labyrinth seal teeth. The labyrinth seal teeth terminate in tapered edges spaced from a surface of the platform and preferably serve as backup seals to the brush seal. The labyrinth teeth thus are preferably located on the downstream side of the brush seal. Should the brush seal fail, the labyrinth teeth limit performance degradation. The brush seal, however, may be located downstream of the labyrinth seal teeth or intermediate the labyrinth seal teeth. Also, since the areas of the upstream and downstream sides of the pedestal exposed in the cavity integrally of the diaphragm, i.e., the wheelspace, are substantially equal, no net axial thrust from leakage flows past labyrinth seals occurs.

In a preferred embodiment according to the present invention, there is provided a steam turbine comprising a rotatable component including a rotor shaft having a rotor shaft surface and a non-rotatable component about the rotatable component, a brush seal carried by the non-rotatable component for sealing engagement with the rotatable component, at least a pair of wheels on the rotatable component spaced axially from one another, the rotatable component including a plurality of buckets spaced circumferentially from one another on each of the wheels, means for inhibiting non-uniform circumferential heat transfer to the rotor shaft surface due to heat generated by frictional contact between the brush seal and the rotatable component thereby to eliminate or minimize bow of the rotatable component, the inhibiting means including an annular platform projecting radially outwardly of the rotor shaft surface at an axial location between the wheels, the brush seal being disposed between the buckets on the wheels and engaging a sealing surface on the platform radially outwardly of the rotor shaft surface.

In a further preferred embodiment according to the present invention, there is provided in a steam turbine having a rotatable component including a rotor shaft having a rotor shaft surface and a non-rotatable component about the rotatable component carrying a brush seal for sealing engagement with the rotatable component along a steam leakage flow path, a method of substantially eliminating bowing of the rotor shaft resulting from circumferential non-uniform distribution of heat about the rotatable component due to heat generated by frictional contact between the brush seal and the rotatable component comprising inhibiting circumferential non-uniform heat transfer to the rotatable component due to heat generated by frictional contact between the rotatable component and the brush seal by locating the area of frictional contact between the rotatable component and the brush seal along a sealing surface spaced radially outwardly of the rotor shaft surface and in radial registration with the rotor shaft surface and a wheelspace portion between the sealing surface and the rotor shaft surface.

DETAILED DESCRIPTION OF THE INVENTION

Figure 1:
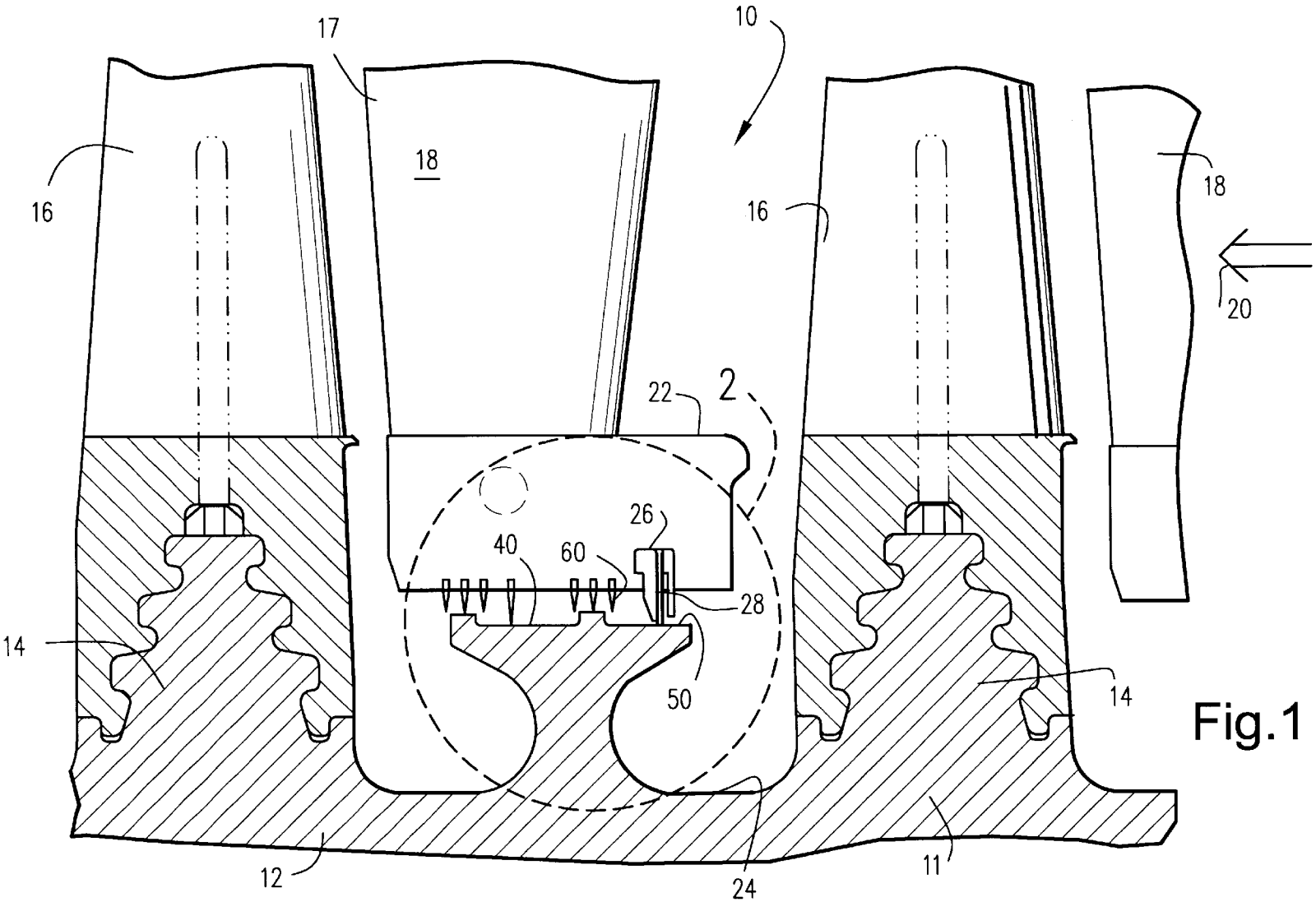
FIG. 1 is a schematic cross-sectional view of a portion of a steam turbine illustrating turbine buckets and diaphragms along the turbine shaft and the location of the combined brush/labyrinth seals.

Referring now to FIG. 1, there is illustrated a steam turbine, generally designated 10, having a rotational component 11, e.g., a rotor or shaft 12 mounting a plurality of axially spaced wheels 14 for mounting buckets 16. A series of nozzle partitions 18 are interspersed between the buckets and form with the buckets 16 a steam flow path indicated by the arrow 20. The partitions are attached to a diaphragm inner web 22 extending between the wheels 14 of the stages of the turbine, the web and partitions collectively defining a stationary component 17. It will be appreciated that the rotor 12 is a continuous solid elongated piece of metal.

Figure 2:
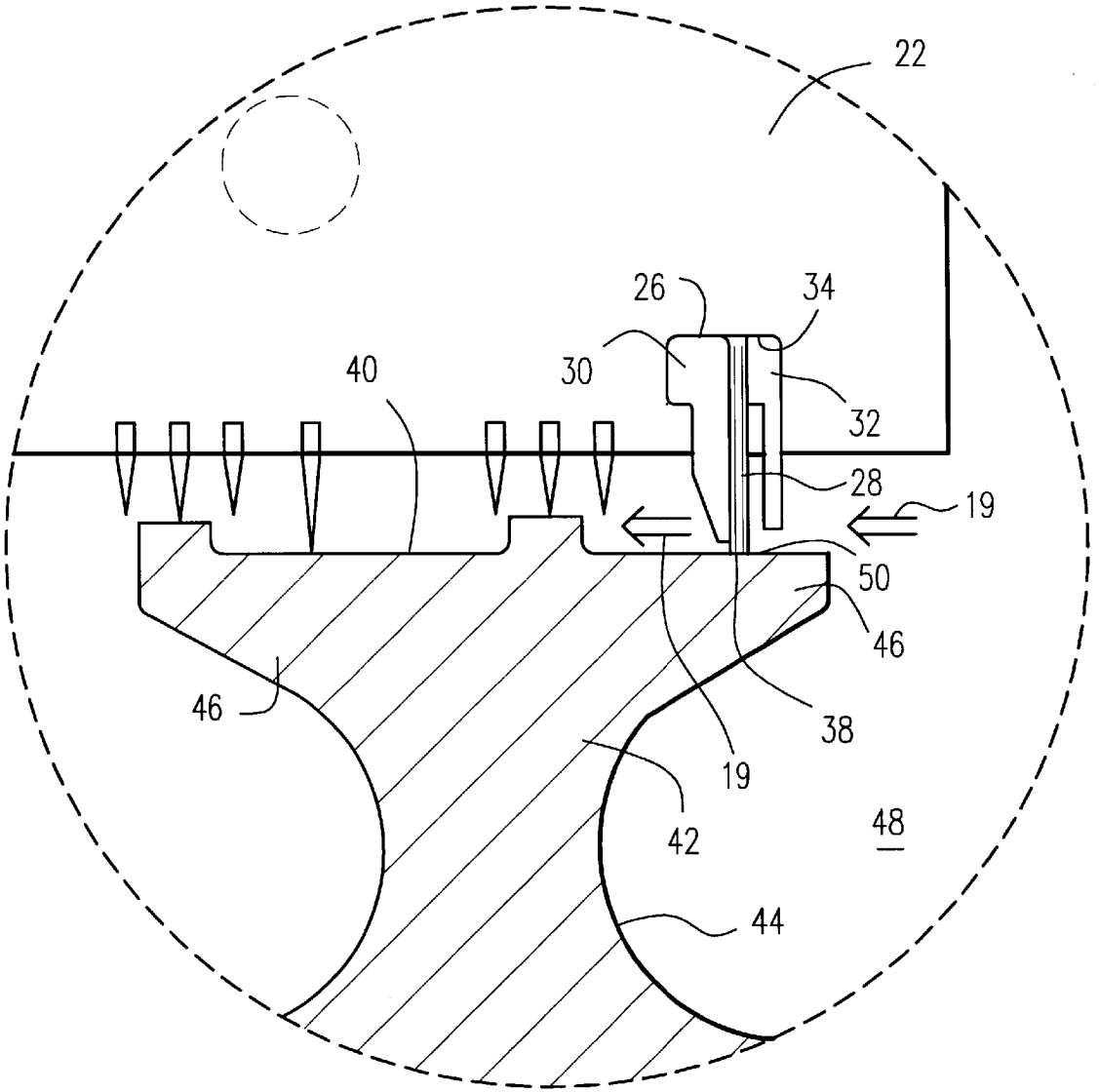
FIG. 2 is an enlarged fragmentary cross-sectional view illustrating a combined brush and labyrinth seal hereof engaging a radially projecting platform in the wheelspace between adjacent buckets.

As previously noted, brush seals have been employed at various locations along a rotor, i.e., between the stationary and rotational components in a steam turbine to form seals. In accordance with a preferred embodiment of the present invention, a brush seal is provided between the stationary and rotatable components 17 and 11, respectively, at a location radially outwardly of the outer surface 24 of rotor 12 in such manner as to prevent non-uniform distribution of heat about the rotor due to frictional contact between the tips of the bristles of the brush seal and the rotor. The brush seal seals along a leakage flow path, indicated by the arrow 19 in FIG. 2, from the steam flow path 20. The brush seal per se may be of conventional construction. For example, as best illustrated in FIG. 2, a brush seal 26 comprises a plurality of preferably metal bristles 28 disposed between a pair of plates 30 and 32 extending circumferentially about the rotor. Brush seal 26 in a preferred embodiment hereof is located and retained in an annular groove 34 formed in the web 22 along a forward portion thereof, i.e., an upstream portion in relation to the direction of leakage steam flow 19. It will be appreciated that the bristles 28 of the brush seal extend at a cant angle relative to radii of the rotor about its axis of rotation and have tips 38 which engage the rotatable component forming a seal therewith.

To prevent a non-uniform distribution of heat about the rotor due to frictional contact between the tips 38 of bristles 28 and a sealing surface of the rotational component, the rotor 12 mounts a platform 40 which projects radially outwardly of the rotor surface 24 and between adjacent wheels 14 of the various rotor stages. Particularly, the platform 40 may comprise an annular, radially extending, pedestal 42 having a neck 44 and at least one and preferably a pair of annular axially extending flanges or fins 46. As specifically illustrated in FIG. 2, the flanges or fins 46 are cantilevered in an axial direction from the reduced neck 44 and hence register radially with a portion of the wheelspace 48 between the wheels 14. The outer surface of the platform 40 and particularly the upstream outer annular surface 50 in radial registration with the tips of the bristles 28 serves as a contact sealing surface with the bristle tips 38. Accordingly, the contact surface between the tips 38 of bristles 28 and the rotational component at which heat is generated by such frictional contact is located both axially and radially spaced from the rotor surface 24. As a consequence, heat generated by such frictional contact is dissipated first in an axial direction toward a central portion of the platform and then radially inwardly along the neck 44 of platform 40. The frictional heat generated is thus dissipated along this path. That is, the platform is configured and has sufficient area to dissipate the heat locally, thus minimizing or eliminating any thermal response of the rotor to thermal effects resulting from the brush seal contact with the sealing surface of the platform 40.

One or more labyrinth seal teeth 60 are also carried by the web 22 in one or more annular arrays thereof about the platform 40. The labyrinth teeth 60 are tapered along their radial inner edges and are spaced a minimal distance from the surface of platform 40 to effect labyrinth-type seals, i.e., afford a tortuous path for any further steam leakage flow escaping past the brush seal. The labyrinth teeth are preferably located downstream of any leakage flow past the brush seal and thus serve as backup seals for the brush seal. Because the brush seal and the labyrinth seal are located substantially on the same diameter, axial rotor thrust resulting from failure of the brush seal is substantially eliminated.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A steam turbine comprising:

a rotatable component including a rotor shaft having a rotor shaft surface and a non-rotatable component about said rotatable component;

a brush seal carried by said non-rotatable component for sealing engagement with the rotatable component;

at least a pair of wheels on said rotatable component spaced axially from one another;

said rotatable component including a plurality of buckets spaced circumferentially from one another on each of said wheels;

means for inhibiting non-uniform circumferential heat transfer to the rotor shaft surface due to heat generated by frictional contact between the brush seal and the rotatable component thereby to eliminate or minimize bow of the rotatable component;

said inhibiting means including an annular platform projecting radially outwardly of said rotor shaft surface at an axial location between said wheels;

said brush seal being disposed between said buckets on said wheels and engaging a sealing surface on said platform radially outwardly of said rotor shaft surface;

said platform including an annular extending pedestal having a neck and at least one flange extending axially toward one of said wheels and away from said neck, said sealing surface being located on said platform flange.

2. A turbine according to claim 1 including a labyrinth seal tooth extending between said stationary component and said platform and axially spaced from said brush seal.

3. A turbine according to claim 2 wherein said rotating component and said stationary component define a steam leakage flow path therebetween, said brush seal being located upstream of said labyrinth tooth in said leakage flow path.

4. A turbine according to claim 1 wherein said non-rotatable component has a diaphragm with an inner web spaced radially outwardly of said platform and in radial registration therewith, said brush seal extending from said web and engaging the sealing surface on said platform.

5. A turbine according to claim 4 including a labyrinth tooth extending from said web terminating in a tooth tip radially spaced from said platform, said labyrinth tooth being spaced axially from said brush seal, said rotating component and said stationary component defining a steam leakage flow path therebetween, said brush seal being located upstream of said labyrinth tooth in said steam leakage flow path.

6. A steam turbine comprising:

a rotatable component including a rotor shaft having a rotor shaft surface and a non-rotatable component about said rotatable component;

a brush seal carried by said non-rotatable component for sealing engagement with the rotatable component;

at least a pair of wheels on said rotatable component spaced axially from one another;

said rotatable component including a plurality of buckets spaced circumferentially from one another on each of said wheels;

means for inhibiting non-uniform circumferential heat transfer to the rotor shaft surface due to heat generated by frictional contact between the brush seal and the rotatable component thereby to eliminate or minimize bow of the rotatable component;

said inhibiting means including an annular platform projecting radially outwardly of said rotor shaft surface at an axial location between said wheels;

said brush seal being disposed between said buckets on said wheels and engaging a sealing surface on said platform radially outwardly of said rotor shaft surface; and including a labyrinth seal tooth extending between said stationary component and said platform and axially spaced from said brush seal, said platform and said stationary component defining a steam leakage flow path therebetween, said brush seal being located upstream of said labyrinth tooth in said steam leakage flow path.

7. A steam turbine comprising:

a rotatable component including a rotor shaft having a rotor shaft surface and a non-rotatable component about said rotatable component;

a brush seal carried by said non-rotatable component for sealing engagement with the rotatable component;

at least a pair of wheels on said rotatable component spaced axially from one another;

said rotatable component including a plurality of buckets spaced circumferentially from one another on each of said wheels;

means for inhibiting non-uniform circumferential heat transfer to the rotor shaft surface due to heat generated by frictional contact between the brush seal and the rotatable component thereby to eliminate or minimize bow of the rotatable component;

said inhibiting means including an annular platform projecting radially outwardly of said rotor shaft surface at an axial location between said wheels;

said brush seal being disposed between said buckets on said wheels and engaging a sealing surface on said platform radially outwardly of said rotor shaft surface;

said platform a pedestal extending annularly about said rotatable component, said pedestal having a radially extending neck and a pair of flanges extending in opposite axial directions from said neck toward said wheels, respectively, said sealing surface being located on one of said flanges.

8. A turbine according to claim 7 including a labyrinth seal tooth extending between said stationary component and said platform and axially spaced from said brush seal, said one labyrinth tooth extending from said non-rotatable component radially toward said platform and another of said flanges.

9. A turbine according to claim 8 wherein said rotating component and said stationary component define a steam leakage flow path therebetween, said brush seal being located upstream of said labyrinth tooth along said steam leakage flow path.

10. In a steam turbine having a rotatable component including a rotor shaft having a rotor shaft surface and a non-rotatable component about the rotatable component carrying a brush seal for sealing engagement with the rotatable component along a steam leakage flow path, a method of substantially eliminating bowing of the rotor shaft resulting from circumferential non-uniform distribution of heat about the rotatable component due to heat generated by frictional contact between the brush seal and the rotatable component comprising:

inhibiting circumferential non-uniform heat transfer to the rotatable component due to heat generated by frictional contact between the rotatable component and the brush seal by locating the area of frictional contact between the rotatable component and the brush seal along a sealing surface spaced radially outwardly of the rotor shaft surface and in radial registration with a wheelspace portion between said sealing surface and the rotor shaft surface, and providing an annular pedestal about the rotor shaft having an axially extending flange radially registering with said wheelspace portion and locating said sealing surface alone said flange.

11. A method according to claim 10 including providing a labyrinth seal between said rotatable and non-rotatable components downstream of said brush seal relative to the steam leakage flow path and radially outwardly of said rotor shaft surface.

* * * * *

UNITED STATES PATENT AND TRADEMARK OFFICE

CERTIFICATE OF CORRECTION

PATENT NO. : 6,669,443 B2
DATED : December 30, 2003
INVENTOR(S) : Burnett et al.

It is certified that error appears in the above-identified patent and that said Letters Patent is hereby corrected as shown below:

Column 6,
Line 23, insert -- including -- before “a” and “pedestal”.
Line 60, delete “alone” and insert -- along --.

Signed and Sealed this

Twenty-third Day of March, 2004

JON W. DUDAS
*Acting Director of the United States Patent and Trademark Office*